US009350116B1

(12) United States Patent
Morello et al.

(10) Patent No.: US 9,350,116 B1
(45) Date of Patent: May 24, 2016

(54) CONNECTOR SYSTEM WITH CONNECTOR POSITION ASSURANCE DEVICE

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/735,406

(22) Filed: Jun. 10, 2015

(51) Int. Cl.

| | |
|---|---|
| ***H01R 13/627*** | (2006.01) |
| ***H01R 13/633*** | (2006.01) |
| ***H01R 24/60*** | (2011.01) |
| *H01R 107/00* | (2006.01) |

(52) U.S. Cl.
CPC ..... *H01R 13/633* (2013.01); *H01R 13/6272* (2013.01); *H01R 24/60* (2013.01); *H01R 2107/00* (2013.01)

(58) Field of Classification Search
CPC ..... H01R 13/6271; H01R 13/6275
USPC ..... 439/352, 353, 357
See application file for complete search history.

(56) References Cited

U.S. PATENT DOCUMENTS 6,106,340 A * 8/2000 Myer ..... H01R 13/4367 439/595
6,261,115 B1 * 7/2001 Pederson ..... H01R 13/641 439/352
6,435,895 B1 8/2002 Fink et al.
6,857,892 B2 2/2005 McLauchlan
7,264,505 B2 * 9/2007 Miyakawa ..... H01R 13/4364 439/595
7,470,138 B1 * 12/2008 Chen ..... H01R 13/506 439/352
7,785,146 B2 * 8/2010 Chazottes ..... H01R 13/4365 439/595
8,092,245 B2 1/2012 Morello et al.
8,137,142 B1 * 3/2012 Dawson ..... H01R 13/639 439/676
2006/0281373 A1 * 12/2006 Anbo ..... H01R 13/4367 439/752
2014/0242823 A1 8/2014 Littek et al.

* cited by examiner

*Primary Examiner* — Abdullah Riyami
*Assistant Examiner* — Thang Nguyen
(74) *Attorney, Agent, or Firm* — Robert Myers

(57) ABSTRACT

A connector system includes a first connector body defining a channel between a longitudinally-oriented fixed wall and a longitudinally-oriented flexible beam. The flexible beam is located opposite and generally parallel to the fixed wall when in a relaxed state. A distal surface of the flexible beam defines a first protrusion having a first inclined surface. A second connector body defines a cavity configured to receive the first connector body. A mesial surface inside the cavity defines a second protrusion having a second inclined surface configured to engage the first inclined surface of the flexible beam when the connector bodies are mated. A member inserted into the channel causes the flexible beam to flex laterally and move the first inclined surface with respect to the second inclined surface sufficient to generate a longitudinal force between the first and second inclined surfaces and thus between the first and second connector bodies.

15 Claims, 7 Drawing Sheets

CONNECTOR SYSTEM WITH CONNECTOR POSITION ASSURANCE DEVICE

TECHNICAL FIELD OF THE INVENTION

The invention relates to a connector systems, particularly a connector system configured to dampen vibration between mating connector bodies in the connector system and assure positional relationships between mating terminals.

BACKGROUND OF THE INVENTION

Sealed connector systems include compliant seals between the mating connector bodies to stop the entry of environmental contaminants, such as, dust, dirt, water or other fluids into the connector bodies of the connector system. These compliant seals also serve to reduce the relative motion between the connector bodies, and hence the electrical terminals within the connector bodies caused by vibration within a vehicle. This relative motion between terminals can cause undesirable intermittent connections or fretting corrosion. Unsealed connection systems do not have compliant seals and typically rely on connector fit/clearances to reduce movement between the connector bodies and can typically only function in lower vibration environments, such as those associated with a vehicle passenger compartment. Sealed connectors may be used in higher vibration environments where their resistance to environmental contaminants is not required; however, sealed connector systems are typically more expensive than equivalent unsealed connector systems. Therefore, it is desirable to have an unsealed connector system that can withstand higher vibration environments.

In addition, as electrical connector systems are miniaturized, the contact surface between mating electrical terminals in the connector system is smaller making alignment, especially longitudinal alignment between the terminals, more critical. Therefore, it is desirable to have a connector system that can help to assure longitudinal location of mating terminals relative to one another.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a connection system is provided. The connector system includes a first connector body that defines a channel between a longitudinally-oriented fixed wall and a longitudinally-oriented flexible beam. The flexible beam is located opposite and generally parallel to the fixed wall when in a relaxed state. A distal beam surface of the flexible beam defines a first protrusion having a first inclined surface. The connector system also includes a second connector body that defines a cavity which is configured to receive the first connector body. A mesial surface inside of the cavity defines a second protrusion having a second inclined surface that is configured to abut and engage the first inclined surface of the flexible beam when the first connector body is disposed within the cavity of the second connector body. The connector system further includes a member that is configured to be inserted within the channel.

When the member is inserted into the channel, it causes the flexible beam to flex laterally and move the first inclined surface with respect to the second inclined surface sufficient to generate a longitudinal force between the first and second inclined surfaces.

According to one particular embodiment of the invention, a mesial beam surface of the flexible beam defines a third protrusion having a third inclined surface. When the member is inserted into the channel, the member engages the third inclined surface and causes the flexible beam to flex laterally and move the first inclined surface with respect to the second inclined surface. The first inclined surface defines a first acute angle with respect to the distal beam surface, and the second inclined surface defines a second acute angle with respect to the mesial cavity surface. An angular measurement of the first acute angle is equal to an angular measurement of the second acute angle. Each longitudinal end of the flexible beam is fixed to the first connector body. The first connector body further comprises an electrical terminal and the second connector body further comprises a corresponding mating electrical terminal. The first connector body defines a flexible latching arm configured to secure the first connector body within the cavity of the second connector body. The member is characterized as a longitudinal member and is defined by a connector position assurance device. The latching arm may be disengaged to release the first connector body from the second connector body by pressing on a free end of the latching arm when the connector position assurance device is in a disengaged position and the latching arm is inhibited from disengagement when the connector position assurance device is in an engaged position. The longitudinal member is not engaged with the first inclined surface when the connector position assurance device is in the disengaged position and the longitudinal member is engaged with the first inclined surface when the connector position assurance device is in the engaged position.

According to another embodiment of the invention, a distal wall surface of the fixed wall defines the third protrusion having a third inclined surface. When the member is inserted into the channel, the member engages the third inclined surface causing the member to flex laterally and contact the flexible beam, thereby causing the flexible beam to also flex laterally and move the first inclined surface with respect to the second inclined surface.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

The connector assembly described herein is designed to connect first connector body to a mating second connector body to provide a tight longitudinal fit. As the first connector is inserted into a shrouded cavity of the second connector, an inclined surface protruding from an outside edge of a flexible beam mounted to the first connector engages a corresponding inclined surface protruding from an inside wall of the cavity. Once the inclined surfaces are engaged, a member is inserted into a cavity behind the flexible beam causing the beam to flex laterally outward. This lateral movement of the flexible beam causes the inclined surfaces to move relative to each other, thereby generating a force in the longitudinal direction that may cause the ends of the first and second connector bodies to move so that they are in intimate contact with each other. This intimate contact reduces the amount of relative vibration between the connectors and hence electrical terminals within the connectors. It also provides longitudinal positional assurance of the connectors and hence electrical terminals within the connectors.

Figure 1:
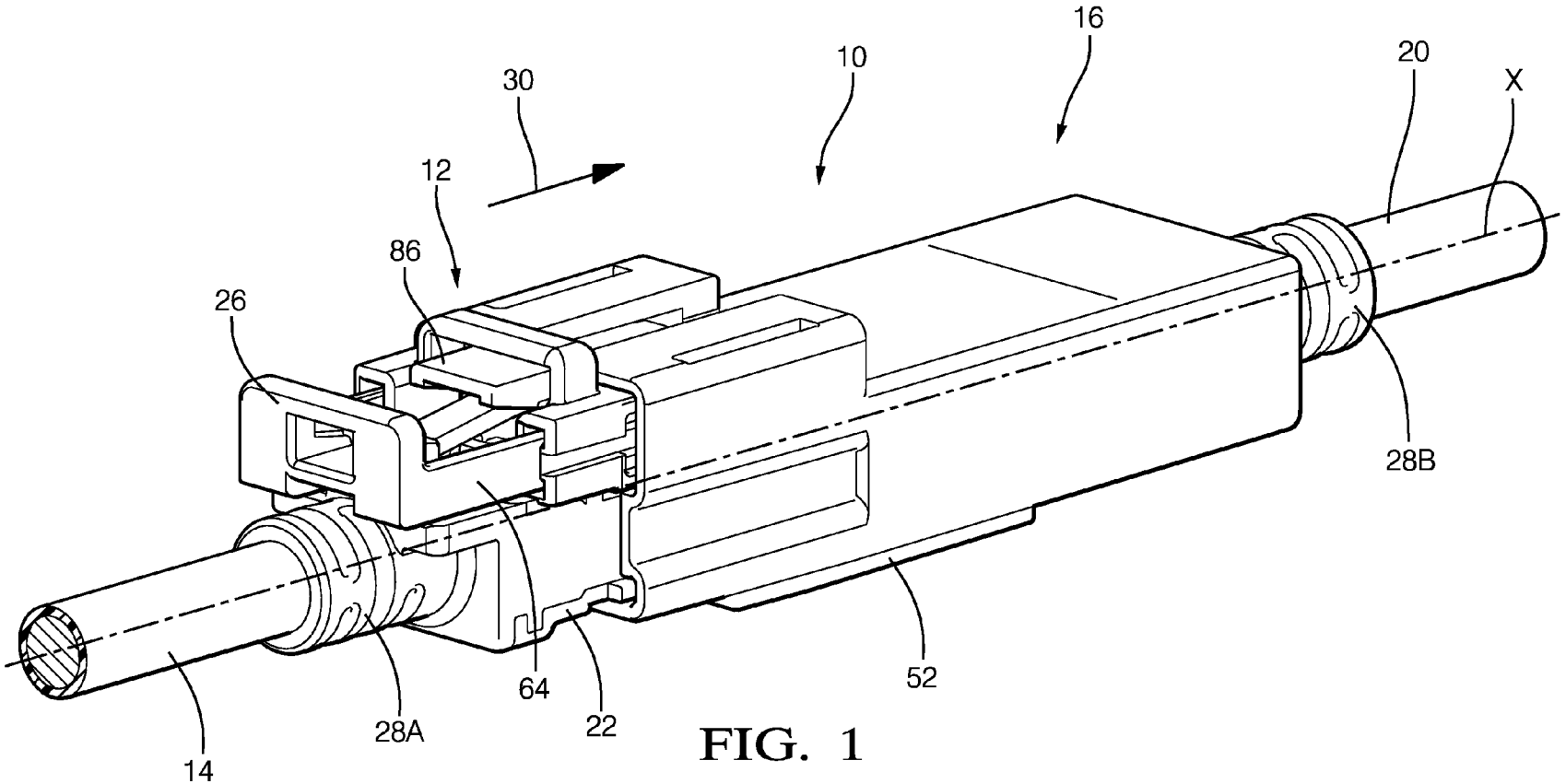
FIG. 1 is a perspective view of a connector system according to one embodiment.

FIG. 1 illustrates an non-limiting example of a connector assembly 10, in this case an electrical connector assembly 10 configured to connect cables carrying signals according to the Universal Serial Bus (USB) 3.0 standard. USB 3.0 electrical terminals have overlapping contact points that may be particularly sensitive to longitudinal location relative to each other. Therefore, reducing the longitudinal tolerance between the terminals is beneficial to the performance of the connector assembly 10. The illustrated connector assembly 10 is configured for application in an automotive environment. The connector assembly 10 includes a first connector 12 holding electrical terminals (not shown due to perspective) for a first wire cable 14. A second connector 16 holds the corresponding mating terminals 18 for a second wire cable 20. The first connector 12 is configured to be received within the second connector 16. The first and second connectors 12, 16 as shown also include locking features to secure the first and second connectors 12, 16 together once the first and second connectors 12, 16 are fully mated.

Figure 2:
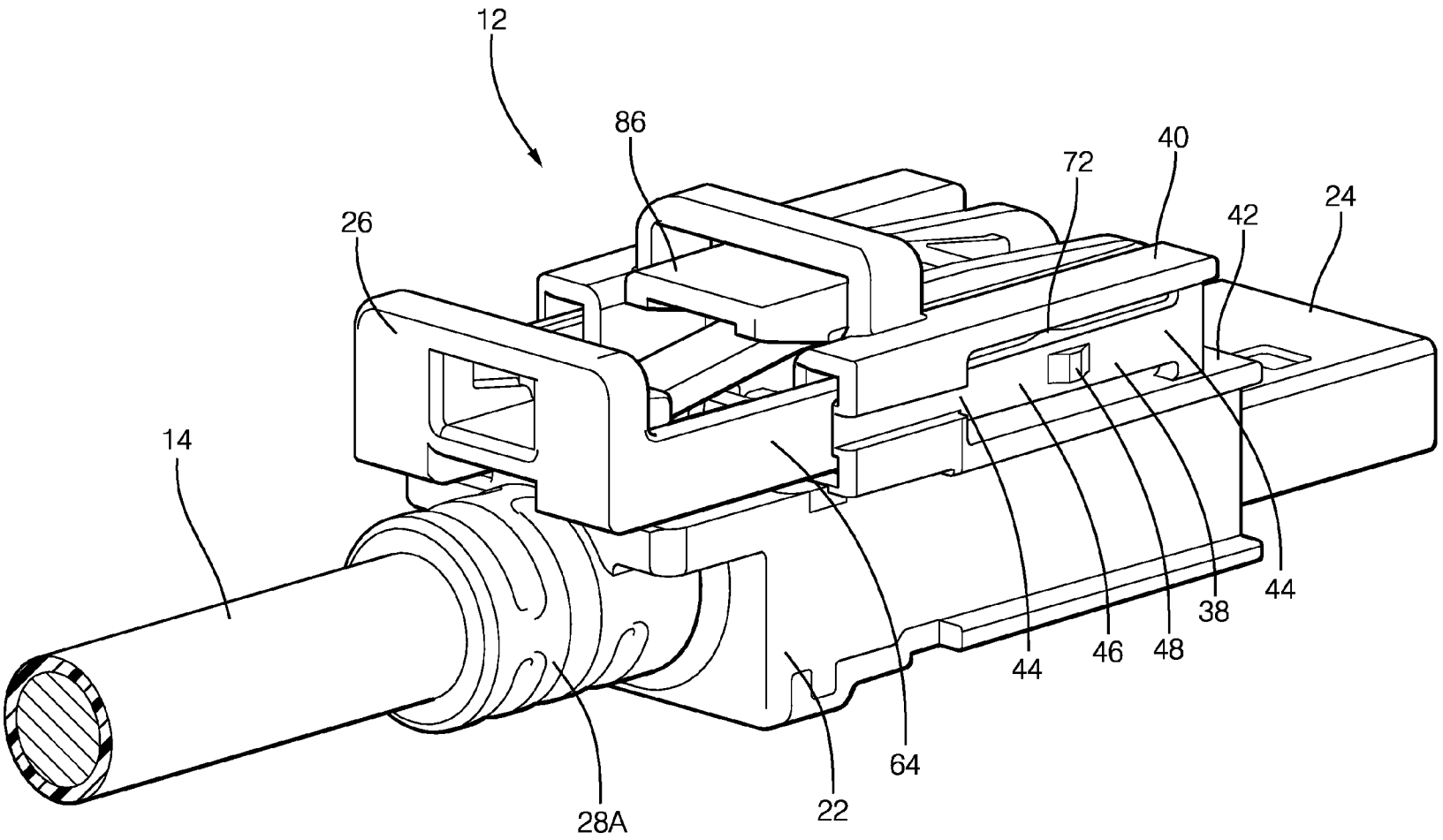
FIG. 2 is a perspective view of a first connector body of the connector system of FIG. 1 according to one embodiment.

FIG. 2 illustrates the first connector 12 that includes a first connector body 22, terminals (not shown due to perspective), a terminal shield 24, a connector position assurance (CPA) device 26, and a wire strain relief device 28A. The first connector body 22 is formed of a dielectric material, for example a polymeric material such as polyamide (PA, commonly known as NYLON), polypropylene (PP), or polybutylene terephthalate (PBT).

As used herein, a mesial location is closer to the longitudinal axis X and a distal location is farther from the longitudinal axis X. As used herein, lateral describes a direction generally perpendicular to the longitudinal axis X. A forward direction is in the insertion direction 30 of the first connector 12 into the second connector 16 along the longitudinal axis X and a rearward direction is opposite the insertion direction 30. A rearward location on the first connector 12 is nearer the first wire cable 14 and on the second connector 16 is nearer the second wire cable 20 and a forward location is nearer the opposite end of the connector along the longitudinal axis X.

The first connector body 22 defines a channel 32 near a distal edge 34 of the first connector body 22. The channel 32 has a longitudinally-oriented and substantially inflexible fixed inner wall 36 and a longitudinally-oriented flexible beam 38 located opposite and generally parallel to the fixed inner wall 36 when the flexible beam 38 is in a relaxed state. The channel 32 also has a longitudinally-oriented and substantially inflexible fixed upper wall 40 and substantially inflexible fixed lower wall 42. The first connector body 22 also includes a second mirror imaged channel 32 on the opposite side of the connector. The flexible beam 38 is integrally formed with the first connector body 22 and is formed from the same material as the first connector body 22. The longitudinal ends 44 of the flexible beam 38 are fixed to the first connector body 22. A distal surface 46 of the flexible beam 38 defines a first protrusion 48 that has a first inclined surface 50 on the rearward side of the first protrusion 48. Alternative embodiments of the flexible beam 38 may be envisioned wherein the flexible beam 38 is not integrally formed or is formed of a different material In other alternative embodiments, the flexible beam may be a cantilevered beam wherein one longitudinal end is fixed to the first connector body and the other longitudinal end is a free end unattached to the first connector body.

Figure 3:
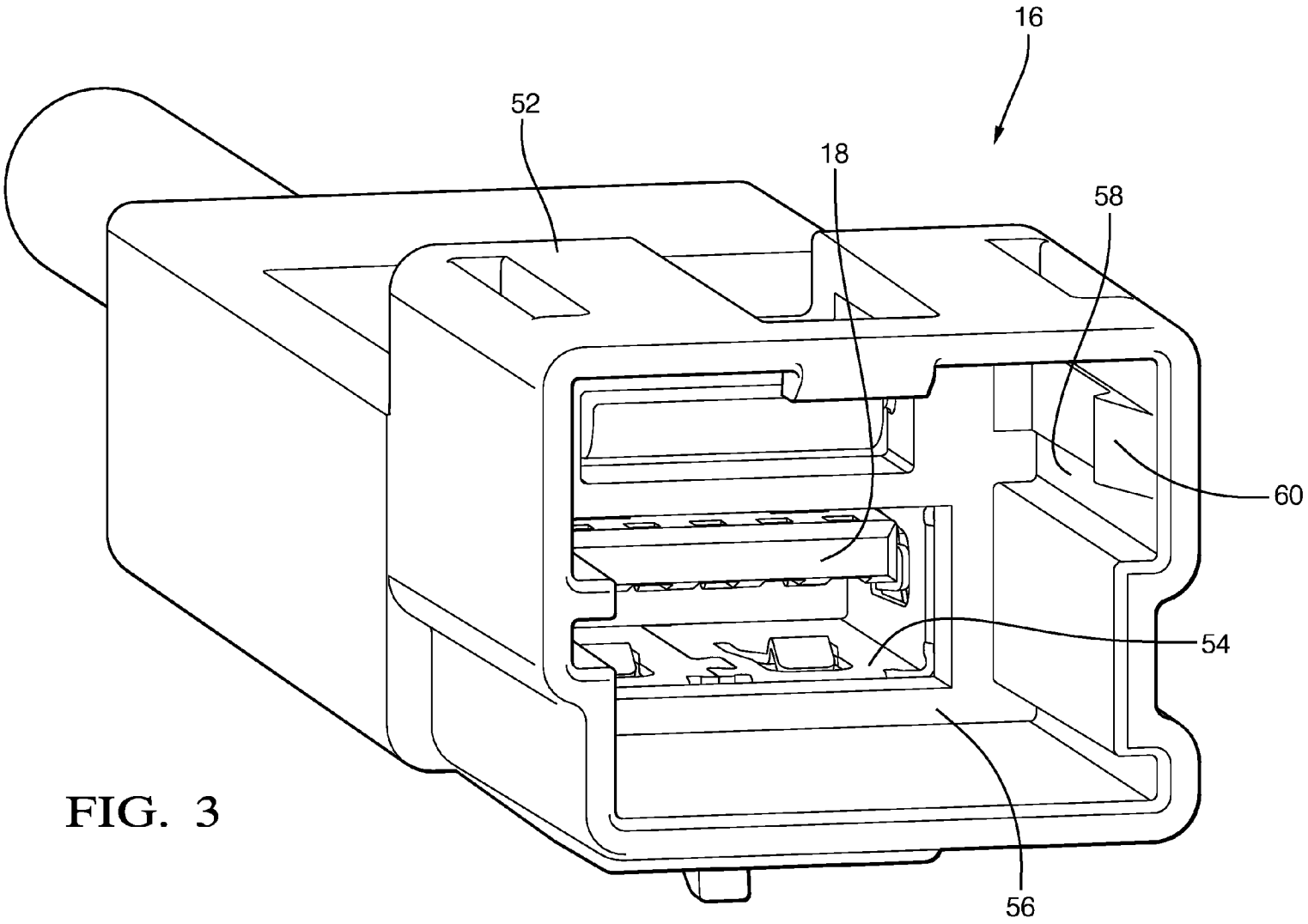
FIG. 3 is a perspective view of a second connector body of the connector system of FIG. 1 according to one embodiment.

FIG. 3 illustrates the second connector 16 that includes a second connector body 52, mating terminals 18, a mating terminal shield 54, and a wire strain relief device 28B (see FIG. 1). The second connector body 52 is also formed of a dielectric material which may or may not be the same material used to form the first connector body 22. The second connector body 52 defines a shroud cavity 56 that is configured to receive the first connector body 22. A mesial surface 58 of the cavity 56 defines a second protrusion 60 having a second inclined surface 62 on the rearward side of the second protrusion 60. The second connector body 52 also includes another mirror imaged second protrusion 60 on the opposite mesial surface of the cavity 56 (not shown due to perspective). The second inclined surface 62 is configured to abut and engage the first inclined surface 50 of the first protrusion 48 defined by the flexible beam 38 when the first connector body 22 is fully inserted within the cavity 56 of the second connector body 52. The first inclined surface 50 defines a first acute angle $\alpha$ with respect to the distal surface 46 of the flexible beam 38, and the second inclined surface 62 defines a second acute angle $\beta$ with respect to the mesial surface 58 of the cavity 56. According to the illustrated example, an angular measurement of the first acute angle $\alpha$ is equal to an angular measurement of the second acute angle $\beta$.

Referring again to FIG. 2, the CPA device 26 defines a pair of longitudinal members 64 that are inserted within each of the channels. When CPA device 26 is moved from a disengaged position 66 to an engaged position 68, the longitudinal members 64 are moved from a rearward position to a forward position within the channel 32. The longitudinal members 64 cause the flexible beams to flex laterally and move the first inclined surfaces 50 with respect to the second inclined surfaces 62 sufficient to generate a longitudinal reaction force F in the forward or insertion direction 30 of the first connector body 22 between the first and second inclined surfaces 50, 62 and thus between the first and second connector bodies 22, 52.

According to the illustrated example shown in FIG. 2, a mesial beam surface 70 of the flexible beam 38 defines a third protrusion 72 having a third inclined surface 74.

Figure 4:
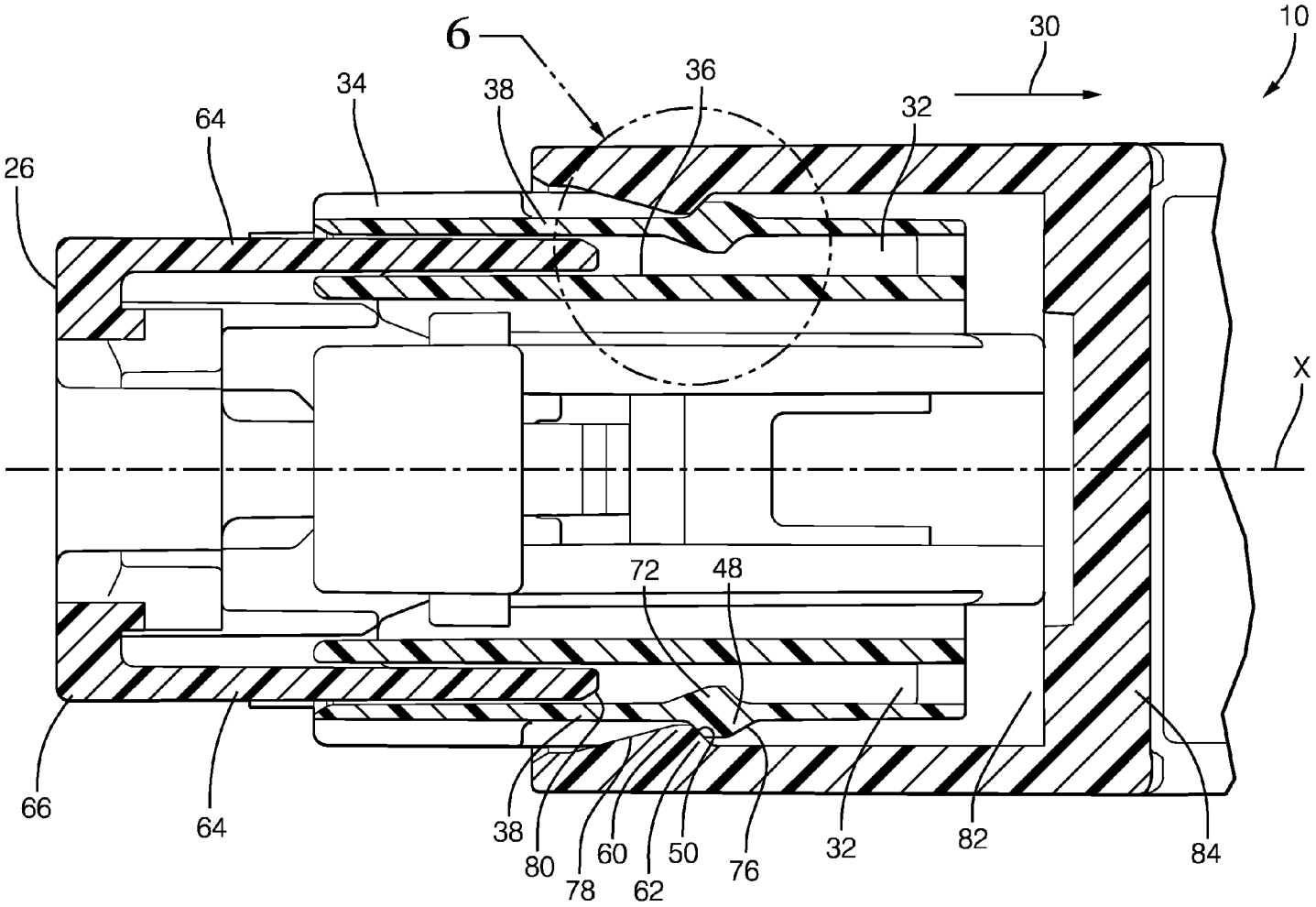
FIG. 4 is a partially cut-away top view of the connector system of FIG. 1 with a connector position assurance device in a disengaged position according to one embodiment.

As illustrated in FIG. 4, the first connector body 22 is fully inserted into the cavity 56 of the second connector body 52. As the first connector body 22 is inserted into the cavity 56 in the forward or insertion direction 30, a fourth inclined surface 76 on a forward edge of the first protrusion 48 engages a fifth inclined surface 78 on a forward edge of the second protrusion 60. As the first connector body 22 is inserted, the fourth and fifth inclined surfaces 76, 78 cause the flexible beam 38 to deflect laterally in a mesial or inward direction allowing the first protrusion 48 to move over and past the second protrusion 60, thereby putting the first and second inclined surfaces 50, 62 into contact.

Figure 5:
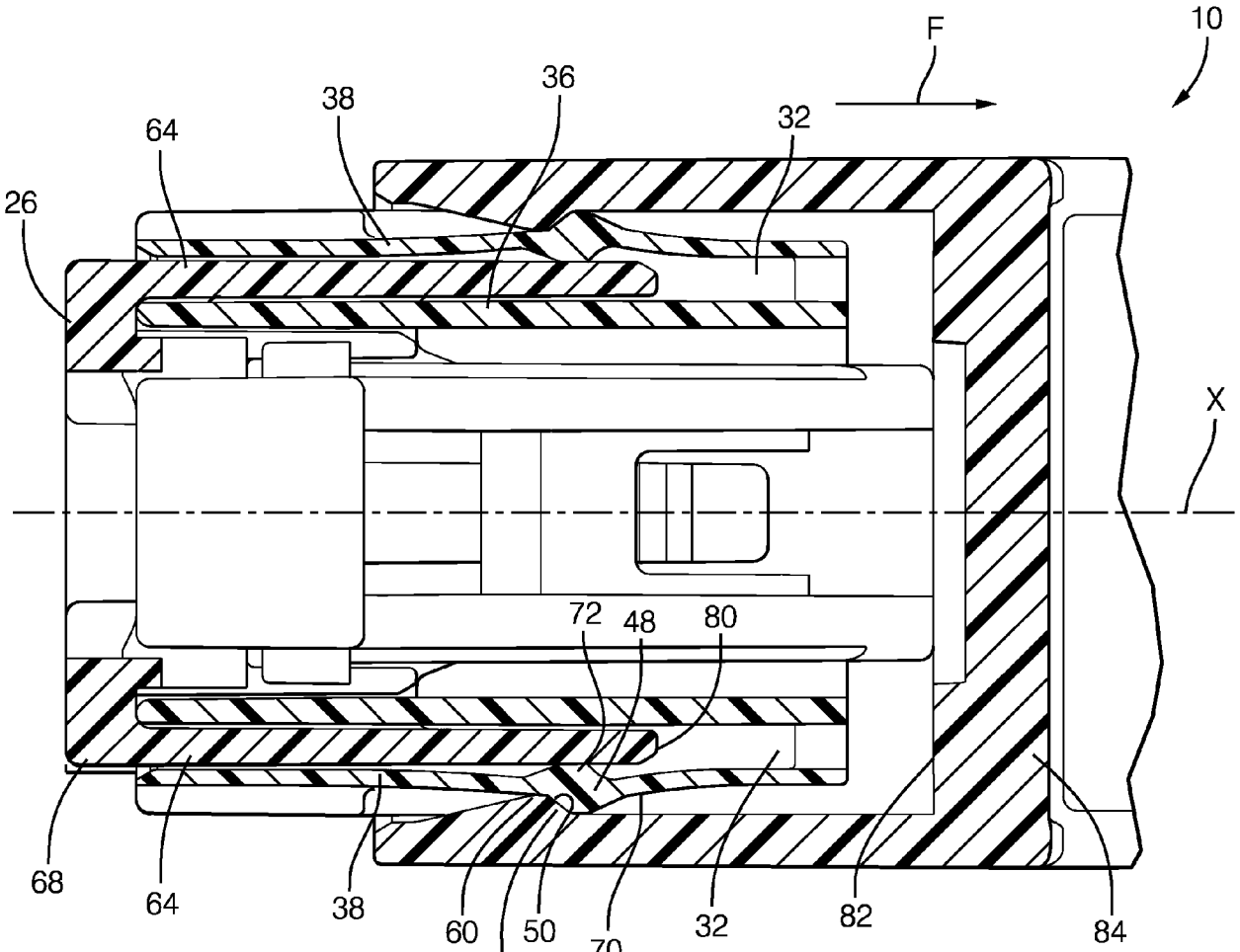
FIG. 5 is a partially cut-away top view of the connector system of FIG. 1 with a connector position assurance device in an engaged position according to one embodiment.

As shown in FIG. 5, when the longitudinal members 64 are inserted into the channel 32, the longitudinal members 64 engage the fixed inner wall 36 and the free end 80 of the longitudinal member 64 contacts the third inclined surface 74. As the free end 80 slides along the third inclined surface 74, the flexible beam 38 is flexed laterally on a distal or outward direction. The lateral movement of the flexible beam 38 causes lateral movement of the first inclined surface 50 with respect to the second inclined surface 62 which produces the reaction force F along the longitudinal axis in the insertion direction 30. The reaction force F generated can be tuned by the angles α, β of the first and second inclined surfaces 50, 62 and the height H of the third protrusion 72.

This reaction force F causes the forward end 82 of the first connector body 22 to snugly engage the rearward end 84 of the connector body. This engagement fixedly locates the first connector body 22 relative to the second connector body 52, thereby reducing vibration between the first and second connector bodies 22, 52 as well as reducing longitudinal locational tolerance between the electrical terminals in the first connector body 22 and the mating terminals 18 in the second connector body 52. The engagement of the first and second protrusions 48, 60 may also reduce lateral locational tolerance between the electrical terminals in the first connector body 22 and the mating terminals 18 in the second connector body 52.

The first connector body 22 includes a flexible latching arm 86 having a lock notch (not shown). The second connector body 52 defines an inwardly extending lock nib (not shown) that is configured to engage the lock notch, thereby providing a primary lock securing the second connector body 52 within the cavity 56 of the first connector body 22. The CPA device 26 is configured to prevent inadvertent disengagement of the lock notch from the lock nib by forming a wedge between the latching arm 86 and the first connector body 22. The lock notch may be disengaged from the lock nib by pressing on a free end of the latching arm 86 when the CPA device 26 is in the disengaged position 66 as shown in FIG. 4 and the lock notch is inhibited from disengaging the lock nib when the CPA device 26 is in the engaged position 68 as shown in FIG. 5. The longitudinal member 64 which is attached to the CPA device 26 is not engaged with the first inclined surface 50 when the CPA device 26 is in the disengaged position 66 as shown in FIG. 4 and the longitudinal member 64 is engaged with the first inclined surface 50 when the CPA device 26 is in the engaged position 68 as shown in FIG. 5. The engagement of the first and second inclined surfaces 50, 62 of the first and second protrusions 48, 60 when the CPA device 26 is in the engaged position 68 may serve as a secondary lock securing the second connector body 52 within the cavity 56 of the first connector body 22. Alternative embodiments of the connector assembly may be envisioned in which the flexible latching arm, lock notch, and lock nib are eliminated and the first and second protrusions provides the primary lock.

Figure 6:
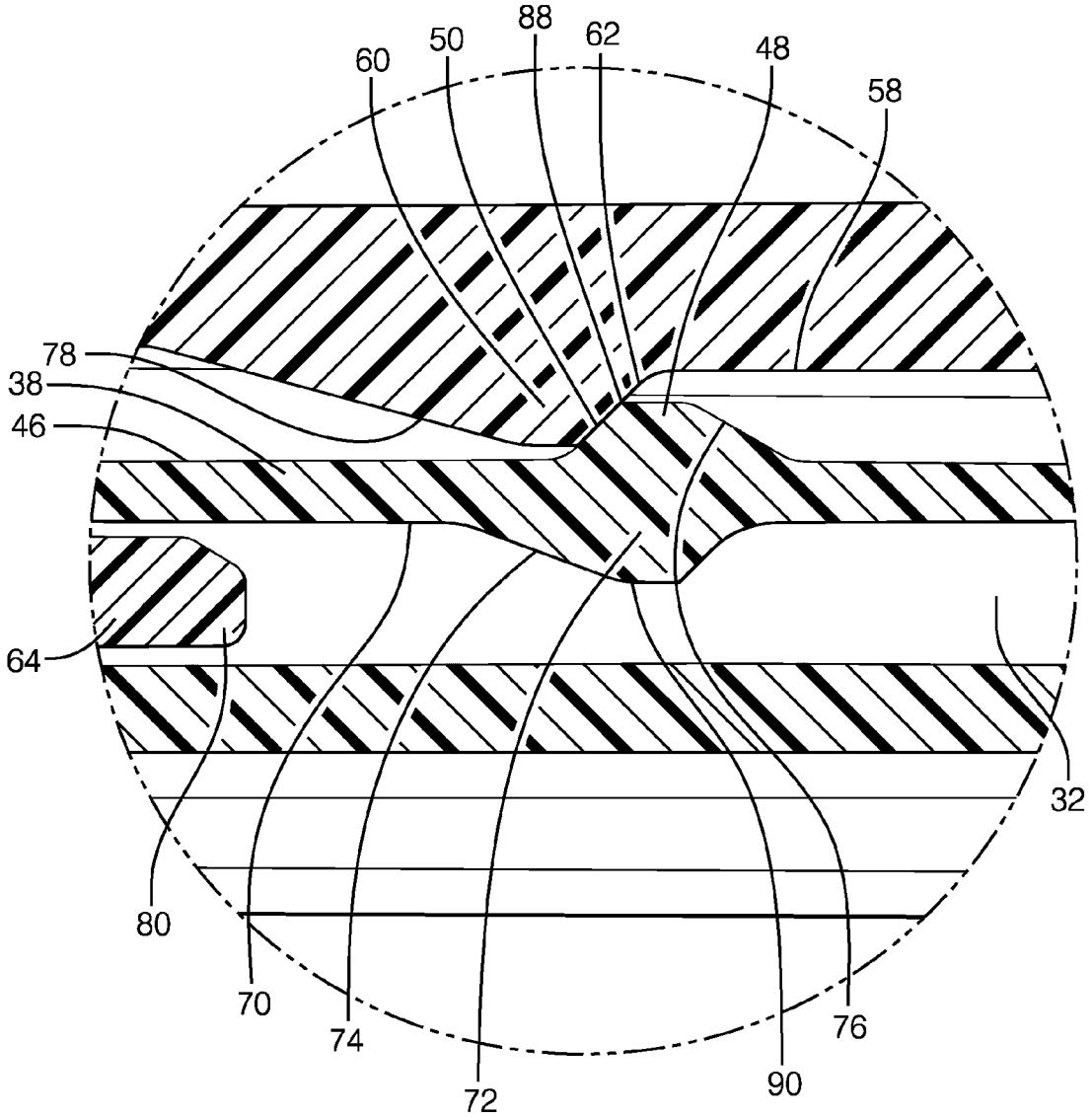
FIG. 6 is a close-up top view of a first, second, and third protrusion of the connector system of FIG. 1 according to one embodiment.

As shown in FIG. 6, the forward end 88 of the first inclined surface 50 is laterally aligned with the forward end 90 of the third inclined surface 74.

Figure 7:
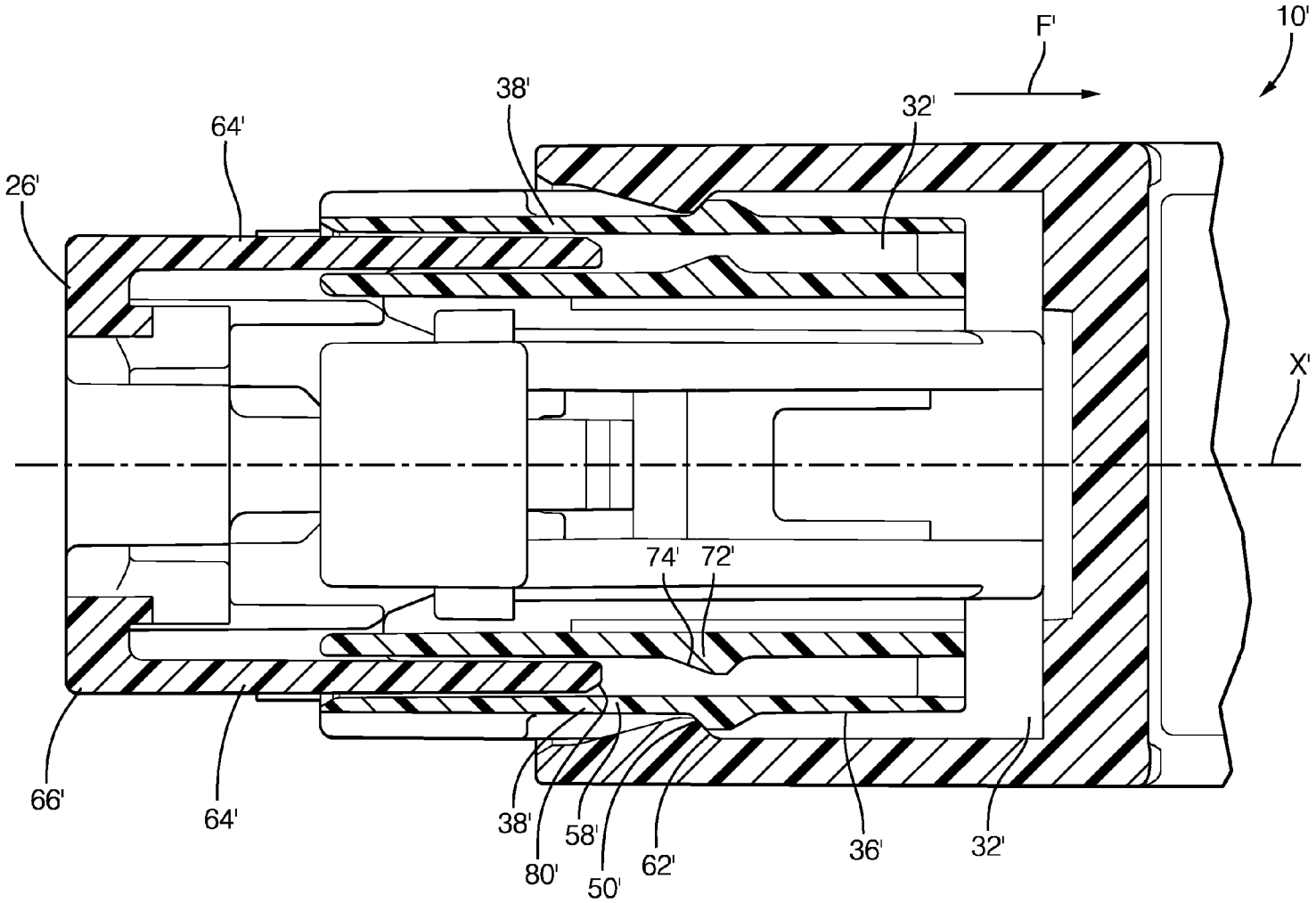
FIG. 7 is a partially cut-away top view of the connector system of FIG. 1 with a connector position assurance device in a disengaged position according to another embodiment.

FIG. 7 illustrates an alternative embodiment of the connector assembly 10' with the CPA device 26' in the disengaged position 66'. According to this alternative embodiment, rather than the third protrusion being defined by the flexible beam, a distal wall surface of the fixed inner wall 36' defines a third protrusion 72' having a third inclined surface 74' and the mesial surface 58' of the flexible beam 38' does not define a protrusion. When the longitudinal member 64' is inserted into the channel 32' as the CPA device 26' is moved from the disengaged position 66', the free end 80' of the longitudinal member 64' contacts the third inclined surface 74' causing the longitudinal member 64' to flex laterally in a distal or outward direction and contact the flexible beam 38', thereby causing the flexible beam 38' to flex laterally. The lateral movement of the flexible beam 38' causes lateral movement of the first inclined surface 50' with respect to the second inclined surface 62' which produces a reaction force F' along the longitudinal axis X' in the insertion direction 30'.

Yet other alternative embodiments of the connector assembly may be envisioned in which a distal surface of the member defines a third protrusion that causes the flexible beam to flex outwardly when the CPA device is moved to the engaged position. The third protrusion may include a third inclined surface that engages a second protrusion on the mesial surface of the flexible beam or the third protrusion may be the sole means for causing the outward flexation of the flexible beam.

The examples presented herein are directed to electrical connector assemblies, however other embodiments of the connector assembly may be envisioned that are adapted for use with optical cables or hybrid connectors including both electrical and optical cable connections. Yet other embodiments of the connector system may be envisioned that are configured to interconnect pneumatic or hydraulic lines. The reaction force generated by the first and second protrusions may beneficially provide a sealing force to seals interconnecting pneumatic or hydraulic lines.

Accordingly a connector assembly 10, 10' is provided. The connector assembly 10, 10' has a fixed inclined surface 62 and a movable inclined surface 50 that generates a reaction force F to snugly engage a pair of first and second connectors 12, 16 that can limit the amount of vibrational movement between the first and second connectors 12, 16 and longitudinally locate the first and second connectors 12, 16 relative to each other. This is particularly beneficial for connector assemblies 10, 10' having terminals with overlapping contact points that may be particularly sensitive to longitudinal location relative to each other, such as a USB 3.0 connector assembly. The fixed and moveable inclined surfaces 50, 62 may further laterally locate the first and second connectors 12, 16 relative to each other. The fixed and moveable inclined surfaces 50, 62 also provide a primary or secondary lock feature to secure the first and second connectors 12, 16 to one another.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector system, comprising:

a first connector body defining a channel between a longitudinally-oriented fixed wall and a longitudinally-oriented flexible beam located opposite and generally parallel to the fixed wall when in a relaxed state, wherein a distal beam surface of the flexible beam defines a first protrusion having a first inclined surface;

a second connector body defining a cavity configured to receive the first connector body, wherein a mesial cavity surface of the cavity defines a second protrusion having a second inclined surface that is configured to abut and engage the first inclined surface when the first connector body is disposed within the cavity of the second connector body; and a member configured to be inserted within the channel and, when inserted into the channel, causes the flexible beam to flex laterally and move the first inclined surface with respect to the second inclined surface sufficient to generate a longitudinal force between the first and second inclined surfaces.

2. The connector system according to claim 1, wherein a mesial beam surface of the flexible beam defines a third protrusion having a third inclined surface and when inserted into the channel, the member engages the third inclined surface causing the flexible beam to flex laterally and move the first inclined surface with respect to the second inclined surface.

3. The connector system according to claim 1, wherein the first inclined surface defines a first acute angle with respect to the distal beam surface, and the second inclined surface defines a second acute angle with respect to the mesial cavity surface.

4. The connector system according to claim 3, wherein an angular measurement of the first acute angle is equal to an angular measurement of the second acute angle.

5. The connector system according to claim 1, wherein each longitudinal end of the flexible beam is fixed to the first connector body.

6. The connector system according to claim 1, wherein the first connector body further comprises an electrical terminal and the second connector body further comprises a corresponding mating electrical terminal.

7. The connector system in accordance with claim 1, wherein the first connector body defines a flexible latching arm configured to secure the first connector body within the cavity of the second connector body.

8. The connector system according to claim 7, wherein the member is characterized as a longitudinal member and is defined by a connector position assurance device.

9. The connector system in accordance with claim 8, wherein the latching arm may be disengaged when the connector position assurance device is in a disengaged position and wherein the latching arm is inhibited from disengaging when the connector position assurance device is in an engaged position.

10. The connector system in accordance with claim 9, wherein the longitudinal member is not engaged with the first inclined surface when the connector position assurance device is in the disengaged position and the longitudinal member is engaged with the first inclined surface when the connector position assurance device is in the engaged position.

11. The connector system according to claim 1, wherein a distal wall surface of the fixed wall defines a third protrusion having a third inclined surface and when inserted into the channel, the member engages the third inclined surface causing the member to flex laterally and contact the flexible beam, thereby causing the flexible beam to flex laterally and move the first inclined surface with respect to the second inclined surface.

12. The connector system according to claim 11, wherein the first inclined surface defines a first acute angle with respect to the distal beam surface, and the second inclined surface defines a second acute angle with respect to the mesial cavity surface and wherein an angular measurement of the first acute angle is equal to an angular measurement of the second acute angle.

13. The connector system according to claim 11, wherein each longitudinal end of the flexible beam is fixed to the first connector body.

14. The connector system according to claim 11, wherein the first connector body further comprises an electrical terminal and the second connector body further comprises a corresponding mating electrical terminal.

15. The connector system according to claim 11, wherein the member is characterized as a longitudinal member and is defined by a connector position assurance device.

* * * * *